US008388462B1

(12) United States Patent
Dagley

(10) Patent No.: US 8,388,462 B1
(45) Date of Patent: Mar. 5, 2013

(54) SWINGING AID

(76) Inventor: Tim K. Dagley, Houston, TX (US)

( * ) Notice: Subject to any disclaimer, the term of this patent is extended or adjusted under 35 U.S.C. 154(b) by 0 days.

(21) Appl. No.: 13/482,845

(22) Filed: May 29, 2012

Related U.S. Application Data

(60) Provisional application No. 61/491,610, filed on May 31, 2011.

(51) Int. Cl.
*A63B 69/36* (2006.01)

(52) U.S. Cl. ..... 473/274; 473/257

(58) Field of Classification Search ..... 473/207, 473/208, 211, 257, 266, 269, 274, 275
See application file for complete search history.

(56) References Cited

U.S. PATENT DOCUMENTS

| | | | | |
|---|---|---|---|---|
| 1,962,256 | A * | 6/1934 | Nelson et al. | 473/214 |
| 4,513,972 | A * | 4/1985 | Empie | 473/274 |
| 4,521,023 | A * | 6/1985 | Williams | 473/274 |
| 4,758,000 | A * | 7/1988 | Cox | 473/208 |
| 7,115,051 | B2 * | 10/2006 | Hansberry | 473/423 |
| 8,133,127 | B1 * | 3/2012 | Synder | 473/274 |

* cited by examiner

*Primary Examiner* — Nini Legesse
(74) *Attorney, Agent, or Firm* — Buskop Law Group, PC; Wendy Buskop

(57) ABSTRACT

A swinging aid for training a user can include a base for engaging a surface. The base can be operatively connected to a first portion of an adjustable stand. A horizontal member can connect to a second portion of the adjustable stand. The horizontal member can protrude from the adjustable stand. A head gear can be operatively connected to the horizontal member. The head gear can be configured to move in three dimensions and rotate three hundred sixty degrees to provide active feedback to the user.

21 Claims, 5 Drawing Sheets

SWINGING AID

CROSS REFERENCE TO RELATED APPLICATIONS

The present application claims priority to and the benefit of U.S. Provisional Patent Application Ser. No. 61/491,610; filed on May 31, 2011; and entitled "SWINGING AID." This reference is incorporated in its entirety herein.

FIELD

The present embodiments generally relate to a swinging aid for improving swinging skills of athletes and other users.

BACKGROUND

A need exists for a swinging aid that provides users with pressure as feedback during execution of swings to help the user learn proper swinging techniques in various sports through motor learning or muscle memory.

A need exists for a swinging aid that provides users with pressure as feedback based upon a location and orientation of the user's head in three linear dimensions and a rotational orientation of the user's head.

A need exists for a swinging aid including head gear that releases from the user's head, providing an indication that the user's head was not in the proper location and/or orientation during the execution of a swing.

The present embodiments meet these needs.

BRIEF DESCRIPTION OF THE DRAWINGS

The detailed description will be better understood in conjunction with the accompanying drawings as follows.

Figure 1A:
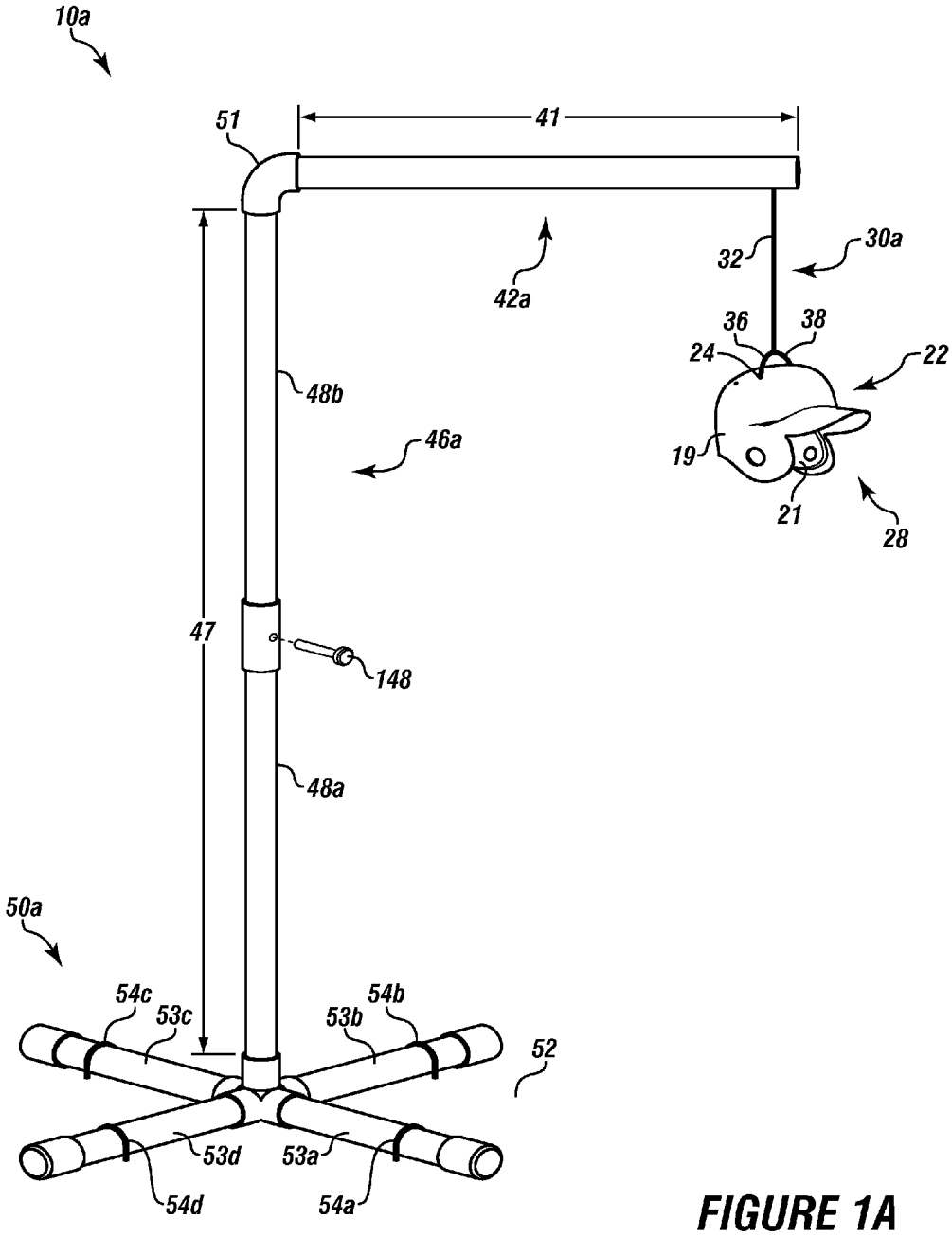
FIG. 1A depicts an embodiment of a swinging aid.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to a swinging aid for improving swinging skills of athletes and other users.

The swinging aid can be formed of one or more segments. The swinging aid can include a base for engaging a surface. The base can be operatively connected to a first portion of an adjustable stand. The base can be connected to the adjustable member as an integral portion. For example, the base and the adjustable member can be formed from a single piece of material.

A horizontal member can be connected to a second portion of the adjustable stand. The base, the adjustable member, and the horizontal member can all be connected as a single piece, i.e., can be formed out of a single piece of material.

In embodiments, one or more portions of the swinging aid can be formed by a separate piece of material and connected to another portion of the swinging aid. Accordingly, the base, the adjustable member, the horizontal member, or combinations thereof can be a single piece, a plurality of pieces connected to one another, or combinations thereof. For example, the horizontal member and the adjustable member can be connected as a single piece of material, and the base can be formed from a separate piece of material and connected to the adjustable member.

The swinging aid can be used to allow a user to work on their head position while performing a swinging action. The user can be an athlete or other person, and can be of any age.

The swinging action of the user can be related to activities requiring proper swing mechanics. For example, the swinging action of the user can be related to swinging a golf club at a golf ball, baseball bat at a baseball, baseball bat at a softball, hockey stick at a hockey puck, hockey stick at a hockey ball, cricket bat at a cricket ball, xistera at a jai alia ball, squash racket at a squash ball, racquetball racket at a racquetball, tennis racket at a tennis ball, or the like.

The swinging aid can be used with a user, such as a young user, who is struggling to hit a ball, such as a baseball. In operation, the user can be continuously told to keep his head still and keep his eye on the ball. The user, without the use of the swinging aid, might determine that he is keeping his head still and eye on the ball; however, results can contradict the user's determination.

The user can use the swinging aid to receive active feedback on the movement of the user's head during the swinging action. For example, a head gear can come off the user's head every time that he moves his head; thereby informing the user that he is moving his head, and reminding the user that he should keep his head still while swinging the bat.

As the user practices with the swinging aid, he can apply proper motor skills and swing techniques by keeping his head still and moving his legs properly while receiving active feedback on his movements.

In one or more embodiments, the swinging aid can be collapsible, portable, adjustable, and lightweight. For example, the swinging aid can have a weight of ranging from about 15 pounds to about 40 pounds.

The swinging aid can provide users with feedback on the proper location and orientation of the user's head, without requiring the use of electricity.

The swinging aid can provide users with instant, continuous, and real-time feedback on the proper location and orientation of the user's head as the user is swinging. For example, the swinging aid can provide active feedback helping a batter to adjust his mechanics, whereas a pitching machine merely lets a batter know if he has missed or fouled a ball.

Use of the swinging aid can enable a user to align the location and orientation of their head and field of vision with a puck or ball to increase the user's probability of contacting the puck or ball during a swing by keeping the head gear on the user's head.

In one or more embodiments, the adjustable stand can be made of hollow aluminum, carbon steel tubing, composites, polyvinyl chloride (PVC), or other structural materials.

The adjustable stand can have a height that can be adjusted from about 18 inches to about 48 inches. The adjustable stand can have a diameter ranging from about 1 inch to about 8 inches.

The base can be connected to one end of the adjustable stand. The base can engage a surface, such as a floor or the ground. The base can be a triangular or cross-shaped base having from about three tubular base members to about four tubular base members. The base and base members can be made of any material.

The base can be configured to support the adjustable stand. The adjustable stand can connect to the base with a mechanical fastener. For example, the base can have a neck for receiving a portion of the adjustable stand and a set screw or force fit can be used to secure the base to the adjustable stand.

In one or more embodiments, a plurality of U-bolts can be disposed about each of the tubular base members and secured to the surface to hold the tubular base members and lock the base to the surface. The U-bolts can be used to stabilize the base.

In one or more embodiments, a base plate can be affixed to the base. The base plate can add weight and stability to the base. The base plate can have a weight sufficient to provide a counterweight; thereby preventing the adjustable stand from tipping or falling.

The horizontal member can be connected to the adjustable stand opposite the base. The horizontal member can extend perpendicular from the adjustable stand.

In one or more embodiments, the horizontal member can have an adjustable length. The length of the horizontal member can be adjusted from about 12 inches to about 96 inches. The horizontal member can have a diameter ranging from about 1 inch to about 8 inches. The horizontal member can be configured to be static and non-rotating.

In one or more embodiments, the horizontal member can be made of hollow telescoping segments, one or more hollow metal segments, one or more hollow polyvinyl chloride segments, one or more rigid non-deforming plastic segments, one or more composite segments, a plurality of segments that are nested together and are lockable, or combinations thereof. The horizontal member can be extendable from the adjustable stand in an amount sufficient to allow one or more athletes to simultaneously practice using the swinging aid.

In one or more embodiments, the adjustable stand can include a vertical member connected to the horizontal member and the base. The vertical member can include one or more segments. The segments of the vertical member can be configured to telescope, nest at least partially within one another and selectively lock in place, connect to one another, or similarly form the vertical member. The segments of the vertical member can be tubular members, cylindrical members, square members, or other shaped members.

In one or more embodiments, a plurality of segments can be used to form the vertical member. The plurality of segments can be configured to fit together to adjust a height of the vertical member. For example, a first segment can be connected to the base, and a second segment can be received within an upper portion of the first segment.

The segments of the vertical member can be hollow. The segments of the vertical member can have a diameter ranging from about 1 inch to about 8 inches.

The plurality of segments can be held within one another by mechanical fasteners, force fits, or combinations thereof. The mechanical fasteners can be snap latches, set screws, threaded fasteners, safety pins, licking pins, pins, or the like.

The vertical member can be adjustable to support the horizontal member at a position above the user's head.

In one or more embodiments, the adjustable stand and the horizontal member can be made from identical materials.

The head gear can be operatively connected to the horizontal member. The head gear can be configured to move in three dimensions and rotate 360 degrees to provide active feedback to the user.

The head gear can be configured to be worn by the user to contain and cover the user's head. The head gear can be a baseball helmet, hockey helmet, softball helmet, cap, hat, or other head gear. For example, the head gear can be manufactured by Dongguan Golden Tie Company of Dongguan, China.

The head gear can be any size to fit any sized user's head. The head gear can be a custom fitted head gear for a particular user. The head gear can be adjustable to various head sizes and can include an adjustable halo.

In one or more embodiments, the head gear can include a face opening, a top portion, a first hole in the top portion, and a second hole in the top portion.

A holding means can be connected to the first hole and the second hole. The holding means can be configured to hold the head gear and allow the head gear to move in three dimensions in the x-y-z spatial coordinate system, and to pivot 360 degrees.

The head gear can include a plastic shell with a liner assembly. The head gear can cover at least a portion of the user's head. The head gear can be configured to provide the user with full visual range.

The head gear can be operatively connected to the horizontal member by the holding means. Illustrative holding means can include a tether connected to the horizontal member that is configured to secure to one or more holes in the top portion of the head gear, a hook connected to the horizontal member configured to engage a latch or fastener on the head gear, a hook connected to the head gear that is configured to engage a loop or latch secured to the horizontal member, a latch connected to the head gear configured to engage a loop secured to the horizontal member, a carbineer connected to a turnbuckle configured to engage a loop secured to the horizontal member, or the like.

In one or more embodiments, the holding means can be connected to the horizontal member opposite the adjustable stand. The holding means can include a tether with a first member engaged with the first hole, and a second member engaged with the second hole. The tether can be engaged with the horizontal member.

The holding means can suspend the head gear a distance from the horizontal member ranging from about 1 inch to about 48 inches, and a distance from the surface ranging from about 36 inches to about 83 inches.

In operation, during execution of swings by the user, the head gear can provide active feedback in the form of pressure to the user's head; thereby allowing the user to modify the location and orientation of the user's head based upon the active feedback. For example, if the user's head is positioned or oriented improperly, the head gear can provide a resistive pressure or tension to the user's head. The active feedback can enable the user to improve the user's swings.

In operation, during execution of swings by the user, the head gear can be configured to release from the user's head to indicate an improper location and orientation of the user's head. For example, if the user's head is positioned or oriented improperly, the holding means can hold the head gear and prevent the head gear from moving with the user's head. As such, when the user's head moves beyond a preset limit in an improper direction, location, or orientation, the head gear releases from the user's head; thereby providing the user with an indication that the user had his head in the improper direction, location, or orientation during execution of the swing.

The holding means can hold the head gear such that the active feedback provided by the head gear enables the user to align the location and orientation of the user's head. Aligning the location and orientation of the user's head can prevent the head gear from releasing from the user's head; thereby improving the user's probability of contacting a puck or ball during swings.

The active feedback can allow the user to control the location and orientation of the user's head in three dimensions in an x-y-z spatial coordinate system. The active feedback can allow the user to control vertical movement of the user's head in a first direction along a y-axis of the x-y-z spatial coordinate system relative to a location of a puck or ball. The active feedback can allow the user to control horizontal movement of the user's head in a second direction along an x-axis of the x-y-z spatial coordinate system relative to the location of the puck or ball. The active feedback can allow the user to control horizontal movement of the user's head in a third direction along a z-axis of the x-y-z spatial coordinate system relative to the location of the puck or ball.

The active feedback can also allow the user to control rotational movement of the user's head about the y-axis, x-axis, and z-axis.

The ability to control the linear and rotational movement of the user's head allows the user to maintain proper location and orientation during swinging, such as staying within a hitting zone for baseball.

EXAMPLE 1

In Example 1, a 10 year old user with 0 years of experience who weighs 65 pounds, has a height of 4 feet and 7 inches, and a helmet size of medium had a 50 percent increase in hitting accuracy.

The user took 10 swings without the swinging aid and did not hit any of the 10 balls. However, while using the swinging aid the user was able to take 10 swings and hit 5 balls out of the 10 balls; thereby improving his hitting accuracy by 50 percent.

EXAMPLE 2

In Example 2, a 5 year old user with zero years of experience who weighs 40 pounds, has a height of 4 feet, and a helmet size of small had a 30 percent increase in hitting accuracy.

The user took 10 swings without the swinging aid and hit 3 balls out of 10 balls. However, while using the swinging aid the user was able to take 10 swings and hit 6 balls out of 10 balls; thereby improving his hitting accuracy by 30 percent.

EXAMPLE 3

In Example 3, an 11 year old user with 3 years of experience who weighs 110 pounds, has a height of 5 feet and 1 inch, and a helmet size of large had a 16.7 percent increase in hitting accuracy.

The user took 30 swings without the swinging aid and hit 16 balls out of 30 balls. However, while using the swinging aid the user was able to take 30 swings and hit 21 balls out of 30 balls; thereby improving his hitting accuracy by 16.7 percent.

Turning now to the Figures, FIG. 1A depicts an embodiment of the swinging aid.

The swinging aid 10*a* can include the adjustable stand 46*a* engaged with the base 50*a*.

The base 50*a* can be configured to engage a surface 52. The base 50*a* can provide a flush engagement with the surface 52.

The base 50*a* can include one or more tubular base members 53*a*, 53*b*, 53*c*, and 53*d*. A plurality of U-bolts 54*a*, 54*b*, 54*c*, and 54*d* can be locked around each of the tubular base members 53*a*-53*d* to hold the tubular base members 53*a*-53*d* and lock the base 50*a* to the surface 52.

The adjustable stand 46*a* can include one or more vertical members 48*a* and 48*b*. The vertical members 48*a* and 48*b* can be connected together. The vertical members 48*a* and 48*b* can be secured relative to one another by a fastener 148, such as a safety pin, locking pin, pin, screw, bolt, or the like.

A first vertical member 48*a* can be connected to the base 50*a*, and a second vertical member 48*b* can be connected to a horizontal member 42*a*.

The vertical members 48*a* and 48*b* can support the horizontal member 42*a* at a position above the user's head. For example, a height 47 of the adjustable stand 46*a* can be adjusted to accommodate various users and support the horizontal member 42*a* at a position above the user's head.

A corner connection 51 can connect the horizontal member 42*a* to the adjustable stand 46*a*.

The horizontal member 42*a* can extend from the adjustable stand 46*a* with a length of extension 41.

The swinging aid 10*a* can include a holding means 30*a* connected to the horizontal member 42*a* opposite the adjustable stand 46*a*.

The swinging aid 10*a* can include a head gear 22 connected to the holding means 30*a* opposite the horizontal member 42*a*. The head gear 22 can have a plastic shell 19 with a liner assembly 21.

In one or more embodiments, the head gear 22 can have a face opening 28. The head gear 22 can be connected to the holding means 30*a*. For example, the holding means 30*a* can be connected to the head gear 22 by a tether 32 connected to a first member 36 and a second member 38.

The first member 36 and second member 38 can be disposed through one or more holes, such as hole 24 located in the top portion of the head gear 22.

The head gear 22 can be connected to the holding means 30*a* such that the head gear 22 can move in three dimensions in the x-y-z spatial coordinate system and pivot three hundred sixty degrees.

Figure 1B:
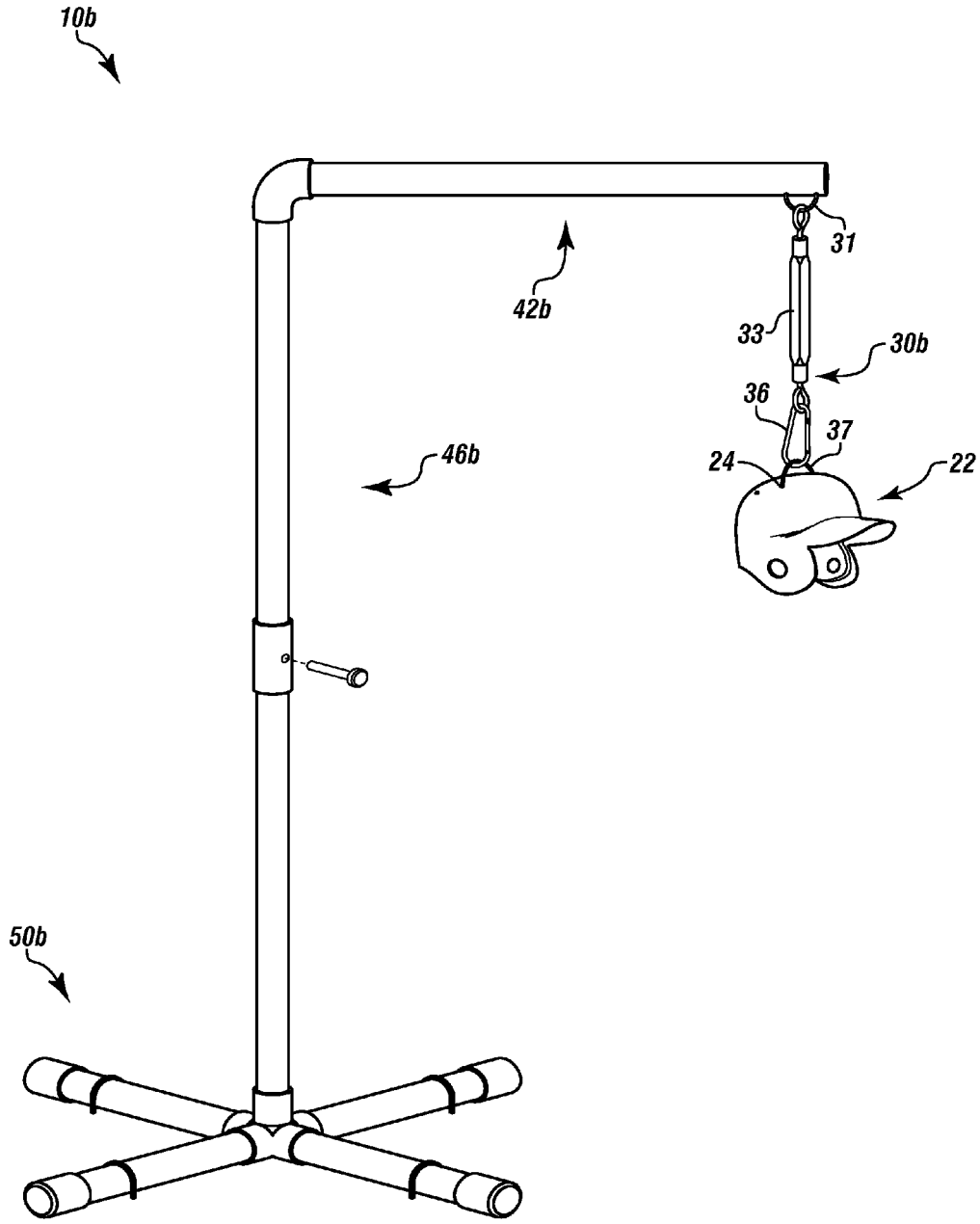
FIG. 1B depicts another embodiment of the swinging aid.

FIG. 1B depicts another embodiment of the swinging aid.

The singing aid 10*b* can include the base 50*a*, the adjustable stand 46*a*, and the horizontal member 42*a*.

The holding means 30*b* can include a loop 31, which can be an integral portion of the horizontal member 42*a*.

The holding means 30*b* can include a turnbuckle 33. The turnbuckle 33 can be connected at one end with the loop 31.

The holding means 30*b* can include a carbineer 35, which can be connected with the turnbuckle 33 opposite the loop 31.

The holding means 30*b* can include a chain 37. The chain 37 can be connected with the carbineer 35 at one end and with holes 24 in the head gear 22 at the opposite end.

Figure 2:
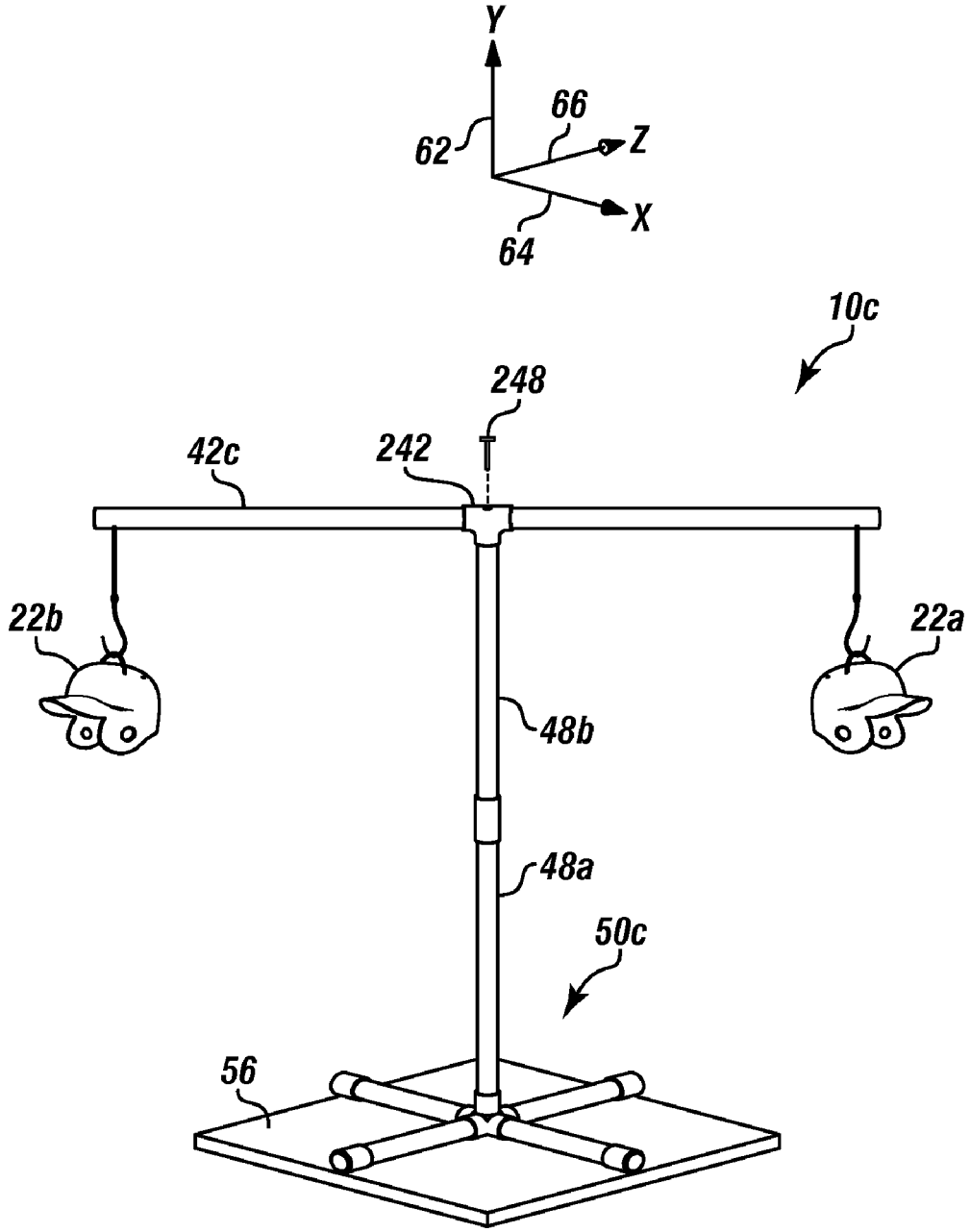
FIG. 2 depicts an embodiment of the swinging aid having multiple head gears for use by multiple users.

FIG. 2 depicts an embodiment of the swinging aid configured for use by multiple users simultaneously.

The swinging aid 10*c* can be configured to allow two athletes to simultaneously practice.

A first head gear 22*a* can be secured to a first portion of the horizontal member 42*b*.

A second head gear 22*b* can be secured to a second portion of the horizontal member 42*b*.

The horizontal member 42*b* can be connected to the second vertical member 48*b* by a T-joint 242. The first vertical member 48*a* can be connected to the base 50*b*. The vertical members 48*a* and 48*b* can be secured relative to one another by a force fit.

A force fit or mechanical fastener can be used to secure the first vertical member 48*a* to the base 50*b*. The base 50*b* can be connected to a base plate 56.

The head gears 22*a* and 22*b* can be configured to move in three dimensions along an x-axis 64, a y-axis 62, and a z-axis 66.

During execution of swings by users, the head gears 22*a* and 22*b* can provide pressure to the users' heads as active feedback. The pressure provided can allow the users to modify a location and orientation of their heads along the x-axis 64, the y-axis 62, and the z-axis 66.

In operation, the pressure provided by the head gears 22*a* and 22*b* as active feedback can be the lowest when the location and orientation of each user's head is proper. As each user's head moves further away from the proper location and orientation, the pressure can increase until the pressure is sufficient to cause release of the head gears 22*a* and 22*b* from the users' heads.

The head gears 22*a* and 22*b* can also release from the users' heads if the users' heads rotate too much about the x-axis 64, the y-axis 62, or the z-axis 66.

In one or more embodiments, one of the head gears 22*a* and 22*b* can be removed and the horizontal member 42*b* can be adjusted such that the length of the horizontal member 42*b* on one side of the vertical members 48*a* and 48*b* is longer than the length of the horizontal member 42*b* on the other side of the vertical members 48*a* and 48*b*. For example, the second head gear 22*b* can be removed and the horizontal member 42*b* can be moved, allowing the first head gear 22*a* to be a greater distance from the vertical members 48*a* and 48*b*. A fastener 248 can be used to secure the horizontal member 42*b* in a desired or selected position.

In one or more embodiments, the horizontal member 42*b* can include one or more horizontal segments nested with one another, allowing them to be retracted and expanded to adjust the length of the horizontal member 42*b*.

When in a desired position, the horizontal segments can have snap latches for locking the horizontal segments in place. In embodiments, the horizontal member 42*b* can include one or more horizontal segments that can connect to one another to adjust the length of the horizontal members 42*b*.

Figure 3:
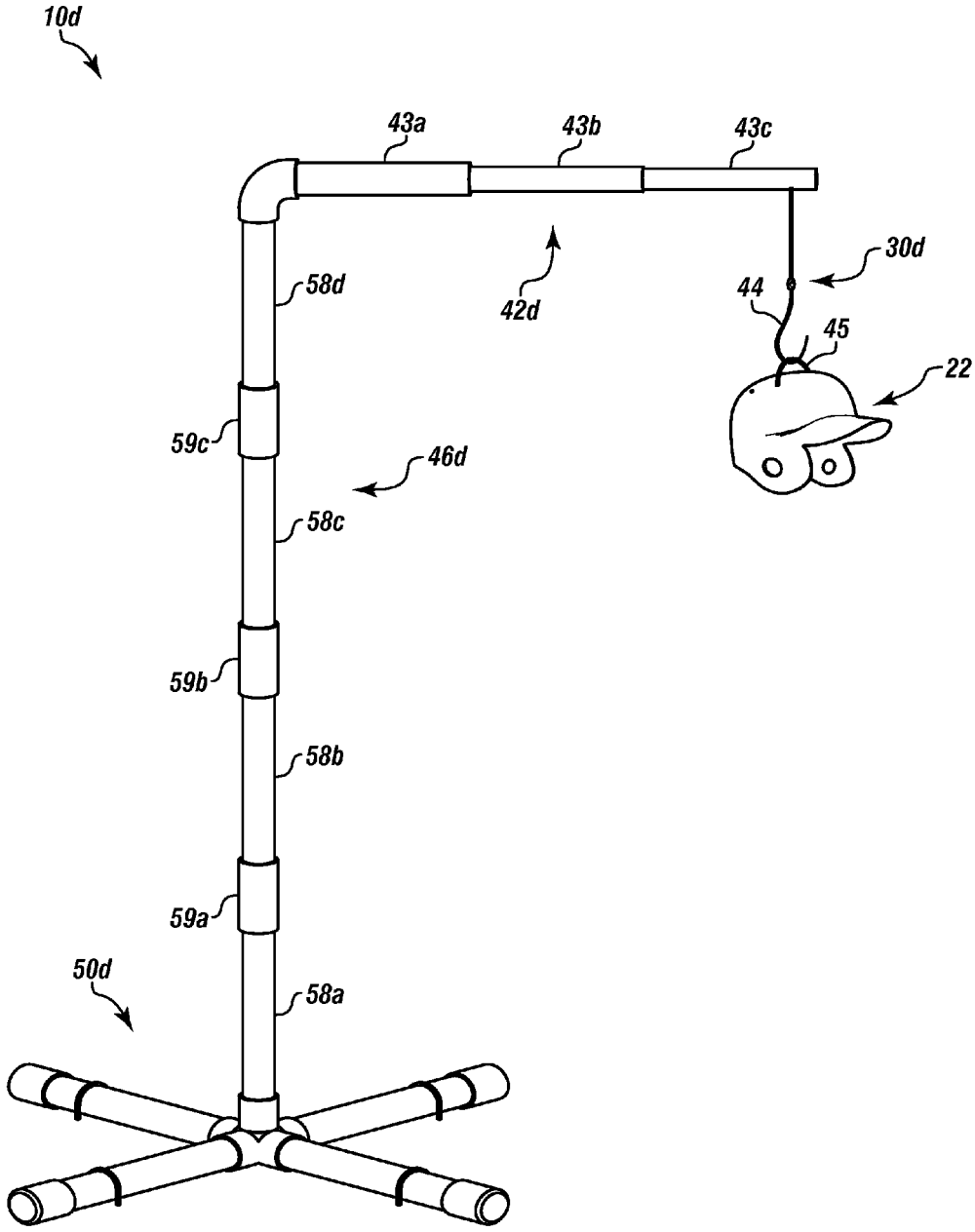
FIG. 3 depicts another embodiment of the swinging aid with an expandable horizontal member.

FIG. 3 depicts an embodiment of the swinging aid with the horizontal member extended from the adjustable stand.

The horizontal member 42*c* of the swinging aid 10*d* can extend from the adjustable stand 46*b*.

The horizontal member 42*c* can include a plurality of horizontal segments 43*a*, 43*b*, and 43*c*. The horizontal segments 43*a*-43*c* can be telescoping or otherwise configured to be selectively expanded. The horizontal segments 43*a*-43*c* can be connected or secured to one another by one or more joints, fasteners, or combinations thereof. Accordingly, the horizontal segments 43*a*-43*c* can be nested and extendable, telescoping, connectable, and securable in a desired location; thereby allowing the horizontal member 42*c* to be extended and retracted from the adjustable stand 46*b*. The horizontal segments 43*a*-43*c* can be securable in a desired location by a force fit, mechanical fasteners, or other means.

The adjustable stand 46*b* can be made of a plurality of vertical segments 58*a*, 58*b*, 58*c*, and 58*d* that are configured to be fastened together. For example, mechanical fasteners, force fits, snap latches, or the like can be used to secure the vertical segments 58*a*-58*d* in place.

The vertical segments 58*a*-58*d* can be nested within one another and can be extracted or expanded to increase the height of the adjustable stand 46*b*.

The vertical segments 58*a*-58*d* can be telescoping or otherwise configured to be selectively expanded.

The vertical segments 58*a*-58*d* can be connected or secured to one another by joints 59*a*, 59*b*, and 59*c*. The joints 59*a*-59*c* can be configured to secure the vertical segments 58*a*-58*d* in place. For example, mechanical fasteners, snap latches and holes, force fits, or combinations thereof can be used to form the joints 59*a*-59*c*.

The base 50*a* can connect to the first vertical segment 58*a*. The base 50*a* can have one or more tubular base members.

The holding means 30*c* can include a hook 44 attached to the horizontal member 42*c*, and a latch 45 attached to the head gear 22. The hook 44 can be engaged with the latch 45.

Figure 4:
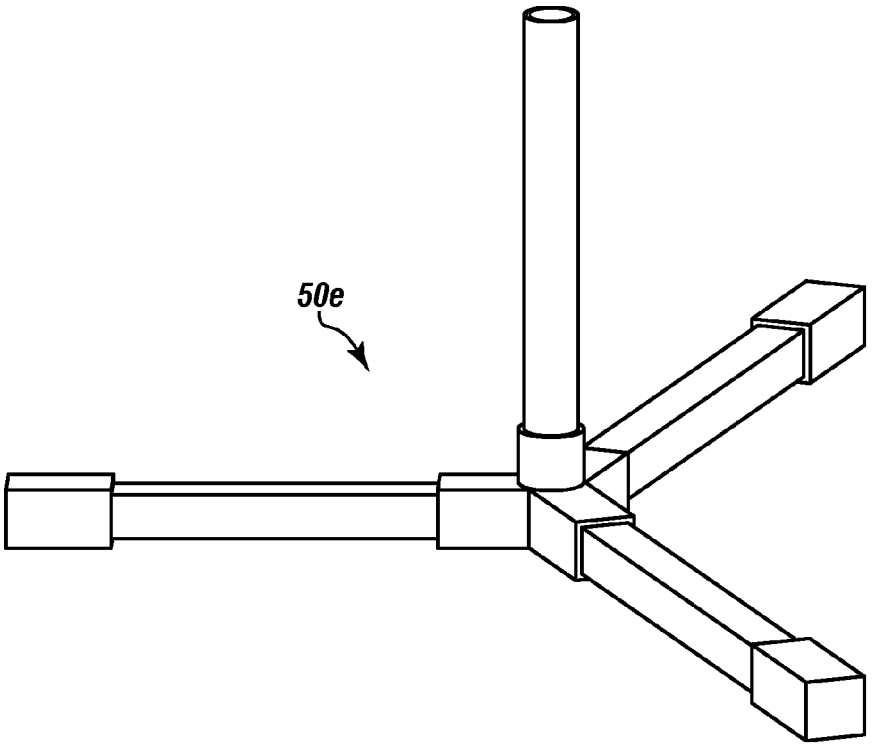
FIG. 4 depicts an embodiment of a triangular shaped base.

FIG. 4 depicts another embodiment of the base.

The base 50*c* can be a triangular base.

Figure 5:
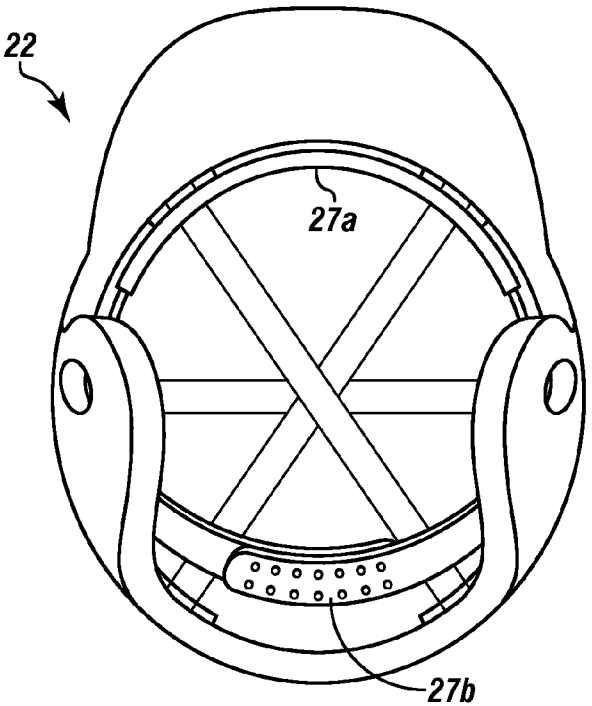
FIG. 5 depicts an embodiment of the head gear having an adjustable halo.

FIG. 5 depicts an embodiment of the head gear.

The head gear 22 can have an adjustable halo, including a padded portion 27*a* and an adjustable portion 27*b*, which can be adjusted such that the head gear 22 can fit heads of various sizes.

While these embodiments have been described with emphasis on the embodiments, it should be understood that within the scope of the appended claims, the embodiments might be practiced other than as specifically described herein.

What is claimed is:

1. A swinging aid for training a user, the swinging aid comprising:

a. a base for engaging a surface, wherein the base is operatively connected to a first portion of an adjustable stand;

b. a horizontal member connected to a second portion of the adjustable stand, wherein the horizontal member protrudes from the adjustable stand;

c. a head gear operatively connected to the horizontal member, wherein the head gear is configured to move about an x-y-z spatial coordinate system and rotate three hundred sixty degrees about the x-y-z spatial coordinate system to provide active feedback to the user; and d. wherein a holding means operatively connects the head gear to the horizontal member, and wherein the active feedback provided by the head gear comprises release of the head gear from the user's head if the user has improper head movement or positioning.

2. The swinging aid of claim 1, wherein the head gear comprises a face opening, a top portion, and at least one hole in the top portion, and wherein the at least one hole in the top portion is configured to connect to the holding means to allow the head gear to move in three dimensions in the x-y-z spatial coordinate system and to pivot three hundred sixty degrees.

3. The swinging aid of claim 2, wherein the holding means is a tether having at least one member engaged with the at least one hole in the top portion.

4. The swinging aid of claim 1, wherein the horizontal member is configured to be static and non-rotating.

5. The swinging aid of claim 1, wherein the adjustable stand comprises a vertical member, and wherein the vertical member is adjustable to support the horizontal member at a desired or selected position.

6. The swinging aid of claim 5, wherein the vertical member is a telescoping locking extendable body.

7. The swinging aid of claim 5, wherein the vertical member comprises a plurality of vertical segments.

8. The swinging aid of claim 1, wherein at least a portion of the horizontal member is parallel to the surface.

9. The swinging aid of claim 1, wherein the swinging aid is configured for training the user to hit a hockey puck, a hockey ball, a golf ball, a softball, a cricket ball, a jai lai ball, a squash ball, a racquetball, a baseball, a tennis ball, or combinations thereof.

10. The swinging aid of claim 1, wherein the head gear is configured such that pressure provided as a portion of the active feedback is lowest when a location and orientation of the user's head is proper, and wherein the head gear is configured such that the pressure increases until the pressure is sufficient to cause release of the head gear from the user's head when the location and orientation of the user's head is improper.

11. The swinging aid of claim 1, wherein the head gear comprises a plastic shell with a liner assembly.

12. The swinging aid of claim 1, wherein the head gear is adjustable to various sizes.

13. The swinging aid of claim 1, wherein the active feedback allows the user to control a location and orientation of the user's head in three dimensions including:

a. controlling vertical movement of the user's head in a first direction along a y-axis of the x-y-z spatial coordinate system relative to a location of a puck or ball;

b. controlling horizontal movement of the user's head in a second direction along an x-axis of the x-y-z spatial coordinate system relative to the location of the puck or ball;

c. controlling horizontal movement of the user's head in a third direction along a z-axis of the x-y-z spatial coordinate system relative to the location of the puck or ball; and d. controlling rotational movement of the user's head about the y-axis, the z-axis, and the x-axis.

14. The swinging aid of claim 1, wherein the swinging aid is configured to increase a probability of the user contacting a puck or ball during swings by at least ten percent.

15. The swinging aid of claim 1, wherein the horizontal member is extendable from the adjustable stand in an amount sufficient to allow two users to simultaneously practice using the swinging aid.

16. The swinging aid of claim 1, wherein the horizontal member is made of a hollow metal tubular, a hollow polyvinyl chloride tubular, a rigid non-deforming plastic tube, a composite, a plurality of telescoping members that are nested together and are lockable, or a plurality of hollow tubulars.

17. The swinging aid of claim 1, wherein a hook extending from the horizontal member engages a latch on the head gear to operatively connect the head gear to the horizontal member.

18. The swinging aid of claim 1, wherein the base is a triangular shaped base having three tubular base members or a cross-shaped base having four tubular base members.

19. The swinging aid of claim 18, further comprising a plurality of U-bolts disposed about of the tubular base members.

20. The swinging aid of claim 1, further comprising a holing means connecting the horizontal member with the head gear, wherein the holding means comprises a loop connected with the horizontal member, a turnbuckle connected with the loop, a carabineer connected with the turnbuckle opposite the loop, and a chain connected with the carabineer and the head gear.

21. A swinging aid for training a user, the swinging aid comprising:

a. an adjustable stand having a base for engaging a surface;

b. a horizontal member connected to the adjustable stand opposite the base, wherein the horizontal member extends perpendicular from the adjustable stand, wherein a length of extension of the horizontal member from the adjustable stand is adjustable, and wherein a height of the adjustable stand is adjustable to support the horizontal member at a position above the user's head;

c. a holding means connected to the horizontal member opposite the adjustable stand; and d. a head gear connected to the holding means opposite the horizontal member, wherein the holding means is configured to hold the head gear and allow the head gear to move in three dimensions, wherein the head gear is configured to be worn on the user's head, and wherein during execution of swings by the user:

(i) the head gear provides pressure to the user's head as a feedback, allowing the user to modify a location and orientation of the user's head and enabling the user to improve the user's swings; and (ii) the head gear is configured to release from the user's head to indicate an improper location and orientation of the user's head.

* * * * *